US005622423A

United States Patent [19]

Lee

[11] Patent Number: 5,622,423

[45] Date of Patent: Apr. 22, 1997

[54] HAND-CARRIED TRAFFIC CONTROL LIGHT

[76] Inventor: Hang-bok Lee, 340-88 Shindang-dong, Chung-ku, Seoul, Rep. of Korea

[21] Appl. No.: 640,021

[22] Filed: Apr. 30, 1996

[30] Foreign Application Priority Data

Oct. 9, 1995 [KR] Rep. of Korea ..... 95-28142

[51] Int. Cl.[6] ..... F21L 7/00

[52] U.S. Cl. ..... 362/186; 362/102; 362/800

[58] Field of Search ..... 362/184, 186, 362/102, 800, 109, 183, 205, 234, 228; 340/321

[56] References Cited

U.S. PATENT DOCUMENTS

| | | | |
|---|---|---|---|
| 2,611,019 | 9/1952 | Warner | 362/102 |
| 4,782,433 | 11/1988 | Rombough | 362/186 |
| 5,036,442 | 7/1991 | Brown | 362/102 |
| 5,079,679 | 1/1992 | Chin-Fa | 362/800 |
| 5,081,568 | 1/1992 | Dong et al. | 362/102 |
| 5,392,203 | 2/1995 | Harris | 362/186 |

*Primary Examiner*—James C. Yeung
*Attorney, Agent, or Firm*—Shlesinger Arkwright & Garvey

[57] ABSTRACT

A hand-carried traffic control light having signaling and flashing functions is disclosed. The above light has a cylindrical handle receiving batteries and a switch cap with a multistage switch. A longitudinal LED carrier that is formed of a PCB and has a plurality of openings is electrically coupled to the switch cap. A plurality of LEDs are mounted to the openings of the LED carrier respectively to be selectively applied with electric power of the batteries in accordance with a switching motion of the switch. A reflector and a flashing bulb are held on the holding protrusion of the LED carrier. The bulb is selectively applied with electric power of the batteries in accordance with the switching motion of the switch. A color reflecting tube surrounds the LED carrier. An external tube surrounds the color reflecting tube. A transparent cap is fitted over a top of the external tube to protect both the reflector and the bulb.

1 Claim, 3 Drawing Sheets

HAND-CARRIED TRAFFIC CONTROL LIGHT

BACKGROUND OF THE INVENTION

1. Field of the Invention

The present invention relates in general to hand-carried traffic control lights and, more particularly, to a structural improvement in such lights for giving a simple construction to the lights and using the lights as signaling or flashing lights.

2. Description of the Prior Art

A typical hand-carried light, that is used for traffic controlling, military operation controlling, airplane taxiing and safety supervising, has a battery-operated signaling bulb. In order to turn on or turn off the above signaling bulb, the above light is also provided with a switch. In addition, a reflector that reflects the light of the bulb thereby more effectively putting the light from the bulb is preferably installed in a transparent body.

The above hand-carried light has a sufficient visible distance and visual effect particularly at night, interruption of electric power or inclement weather. The hand-carried light can be thus effectively used for signaling or alarming.

The above hand-carried light is further provided with a flashing bulb on its top portion, thus being preferably used for identifying the registered number of a car or mentioned items of a driver's license or searching troubled parts of a car.

Korean U.M. Appln. No. 93-1328 discloses a hand-carried traffic control light provided with signaling and flashing functions. FIG. 4 is an exploded perspective view showing the construction of the above Korean traffic control light.

As shown in FIG. 4, the light includes a cylindrical handle 1 that defines a battery chamber therein. A switch cap 2 is threaded into the top of the above handle 1. The switch cap 2 has a plurality of switches 3. The switches 3 are provided on the outer wall of the cap 2. Both a circuit board 4 and a tube holder 5 are received in the cap 2. A longitudinal LED carrier 7, that carries a plurality of LEDs 6, is axially fitted in the holder 5 and electrically connected to the circuit board 4. The LEDs 6 are axially arranged on the carrier 7 and spaced out at regular intervals. In order to protect the above LED carrier 7, a longitudinal transparent protection tube 8 is fitted over the carrier 7 and held by the holder 5 on its bottom portion. A fitting ring 9 is mounted on the middle portion of the above protection tube 8. The above protection tube 8 is surrounded by a holding pipe 10 and in turn surrounded by a fluorescent pipe 11. An external pipe 12 is fitted over the above fluorescent pipe 11 to protect the pipe 11. A bulb fitting cap 13 is fitted into the top of the external pipe 12. A flashing bulb 14 is fitted in the above cap 13 with a reflector 15. A tightening cap 17 is tightened to the outer-threaded top edge of the above bulb fitting cap 13 with a circular glass panel 16.

In the operation of the above traffic control light, an LED switch 3 is operated to apply the electric power of the batteries in the handle 1 to the LED carrier 7 through the circuit board 4. The LEDs 6 of the carrier 7 are thus intermittently turned on and turned off. The light of the above LEDs 6 comes through the external pipe 12. Since the fluorescent pipe 11 is fitted in the external pipe 12, the light of the LEDs 6 in the above state is diffusion-reflected by the fluorescent pipe 11. The above diffused reflection of the LED's light caused by the fluorescent pipe 11 improves the visual effect of the LED's light coming through the external pipe 12. The above fluorescent pipe 11 also gives luminous effect to the traffic control light when there is no batteries in the handle 1 at night.

In order to use the above light for either identifying the registered number of a car or mentioned items of a driver's license or searching the troubled parts of a car, a bulb switch 3 is operated to directly apply the electric power of the batteries to the flashing bulb 14 thus turning on the bulb 14. The bulb 14 thus puts its light forward through the glass panel 16. The bulb's light is reflected by the reflector 15. The bulb 14 in the above state is continuously turned on, thereby being used for properly identifying the registered number of a car or the mentioned items of a driver's license or search the troubled parts of a car.

However, the above hand-carried light has the following problems caused by its construction.

In the above light, the LEDs 6 are manually welded to the LED carrier 7 one by one. Each LED 6 is welded to a wire that not only holds the LED 6 but also acts as means for transmitting the electric power. Thus, the LEDs 6 may fail to achieve the positional stability. In order to stably hold and protect the carrier 7 with the above LEDs 6, the transparent protection tube 8 is fitted over the carrier 7. The LED carrier 7 is electrically connected to the circuit board 4 by being welded to the board 4. The above hand-carried light has a complex construction and is difficult to produce and assemble.

In order to stably hold the protection tube 8 with the LED carrier 7 in the fluorescent and external pipes 11 and 12, the protection tube 8 must be provided with the fitting ring 9 that has an outer diameter equal to the inner diameter of the external pipe 12. In addition, both the protection tube 8 and the fluorescent pipe 11 must be held by transparent holding pipe 10.

The light of the LEDs 6 thus comes through the protection tube 8, holding pipe 10, fluorescent pipe 11 and external pipe 12. Therefore, the intensity of illumination of the LEDs 6 is remarkably reduced.

In addition, the film pipe 10, fluorescent pipe 11 and synthetic resin pipe 12 are commonly held by the support ring 9 of the protection tube 8, the pipes 10, 11 and 12 may be easily deformed or broken by external shock or temperature variation.

That is, the above hand-carried light has no means for reinforcing and stably holding the flexible and sensitive external pipe 12. The expected life span of the above light is thus shortened.

In order to install both the bulb 14 and the reflector 15 in the light, a plurality of parts, that is, the bulb fitting cap 13, glass panel 16 and tightening cap 17, must be set in the external pipe 12. However, the above parts complicate both the construction of the light and the process for assembling the light.

The above hand-carried light also includes the tube holder 5 for holding the protection tube 8. In addition, various switches 3 are mounted on the switch cap 2 for selectively turning on the various color LEDs 6 of the carrier 7 and the bulb 14. Due to the above switches 3, the light has a complicated construction and is expensive. Due to the above switches 3, the above light is difficult to assemble.

In an effort to overcome the above problems, particularly caused by the LED carrier 7, the applicant of this invention proposed an improved hand-carried light in Korean U.M.

Appln. No. 94-29646 (Japanese U.M. Appln. No. 94-12997; Japanese U.M. Registration No. 3010482).

In the above light, a switch cap is coupled to a handle with a battery chamber. A color reflecting tube is fitted into the top of the switch cap. A switch and a switch connector are provided in the above switch cap, while a longitudinal LED carrier formed of a PCB (printed circuit board) is axially received in the above color reflecting tube. The LED carrier has a plurality of regularly-spaced LEDs. A circuit unit for turning on or off the LEDs is provided on the lower portion of the above LED carrier. The switch connector is electrically connected to an LED connector of the above circuit unit provided in the LED carrier. In the above hand-carried light, both sides of the LED carrier formed of PCB are brought into tight contact with the internal surface of the color reflecting tube, thus structurally reinforcing and stably holding the color reflecting tube. The LEDs are stably installed in the regularly-spaced openings formed on the LED carrier constructed of a PCB, while the circuit unit is provided on the lower portion of the above LED carrier. Due to the above LED carrier, it is not required to provide additional circuit board to the above hand-carried light. The number of parts, the volume and weight of the light are thus reduced, so the above hand-carried light is easily assembled and produced, and effectively used for traffic controlling.

The above hand-carried light overcomes the problems caused by the light disclosed in Korean U.M. Appln. No. 93-1328. However, the above light has no flashing bulbs for putting the light forward, so the light can be used for neither identifying the registered number of a car, mentioned items of a driver's license nor searching the troubled parts of a car at night.

That is, the light disclosed in Korean U.M. Appln. No. 93-1328 includes both the LED carrier and the flashing bulb. The light of LEDs comes through the external pipe when the hand-carried light is used for traffic controlling, while the light of the flashing bulb is put forward when the hand-carried light is used for identifying the registered number of a car or mentioned items of a driver's license or searching the troubled parts of a car. However, the light disclosed in Korean U.M. Appln. No. 94-29646 does not have the flashing bulb for putting the light forward. The above light thus neither identifies the registered number of a car or the mentioned items of a driver's license nor searches the troubled parts of a car at night, while the light can be used for traffic controlling exclusively.

SUMMARY OF THE INVENTION

It is, therefore, an object of the present invention to provide a hand-carried traffic control light in which the above problems can be overcome and which is used for not only signaling but also for flashing for identifying the registered number of a car and the mentioned items of a driver's license or searching the troubled parts of a car at night. The above light has a simple construction and is easily assembled and produced.

In order to accomplish the above object, the present invention provides a hand-carried traffic control light comprising a cylindrical handle receiving batteries and a switch cap threaded into the handle. The switch cap has a multistage switch on its outer wall. A longitudinal LED carrier formed of a printed circuit board is electrically coupled to a connector of the switch cap thereby being connected to the switch. The LED carrier has a plurality of openings. A circuit unit is provided in the LED carrier and connected to both the batteries and the switch. A plurality of LEDs are mounted to the openings of the LED carrier respectively to be electrically connected to the circuit unit thereby being selectively applied with electric power of the batteries in accordance with a switching motion of the switch. A holding protrusion is provided on a top of the LED carrier. A reflector and a flashing bulb are held on the holding protrusion and connected to the circuit unit. The bulb is selectively applied with electric power of the batteries in accordance with the switching motion of the switch. A color reflecting tube surrounds the LED carrier. An external tube surrounds the color reflecting tube. A transparent cap is fitted over a top of the external tube to protect both the reflector and the bulb.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
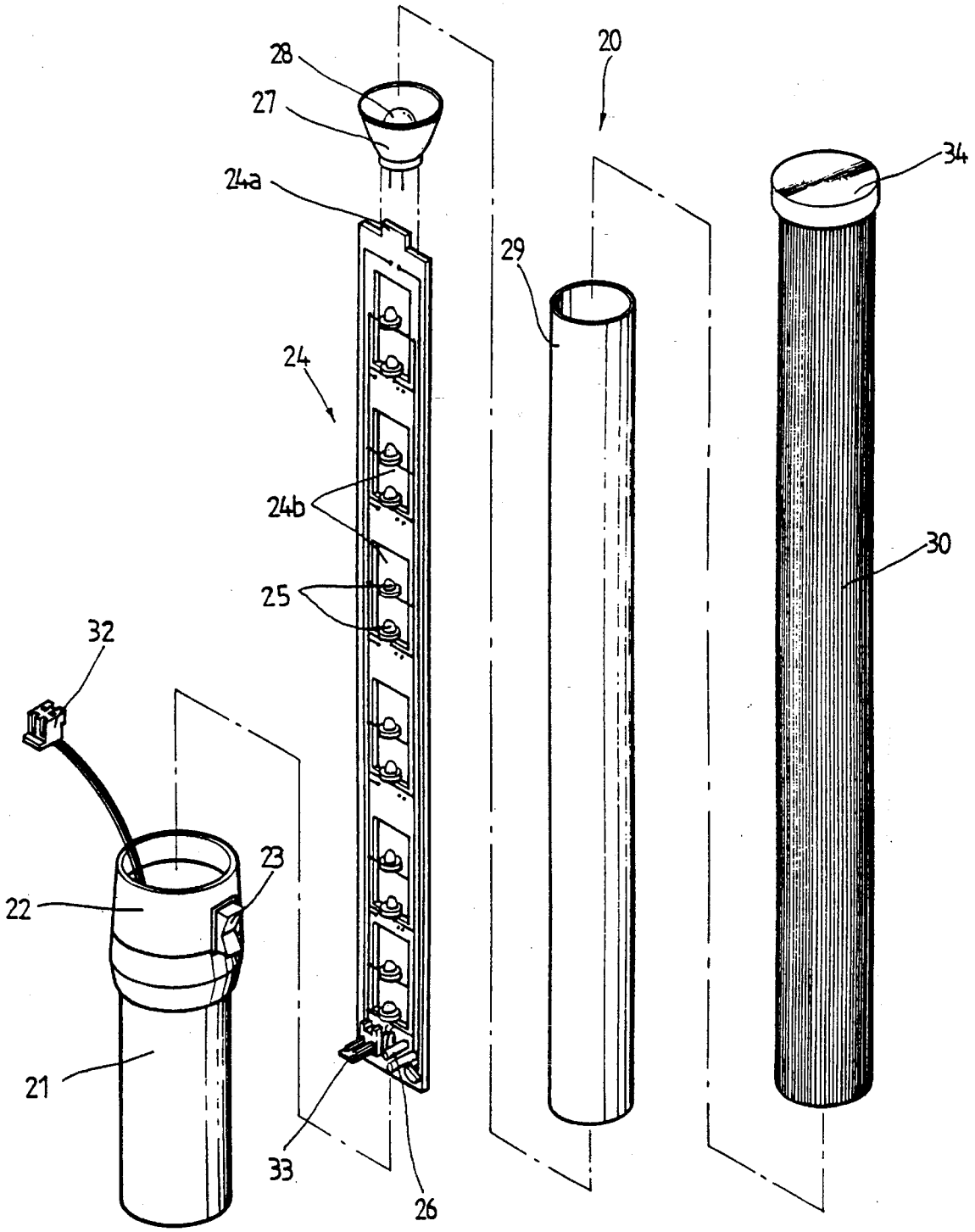
FIG. 1 is an exploded perspective view of a hand-carried traffic control light in accordance with a preferred embodiment of the present invention.
Figure 3:
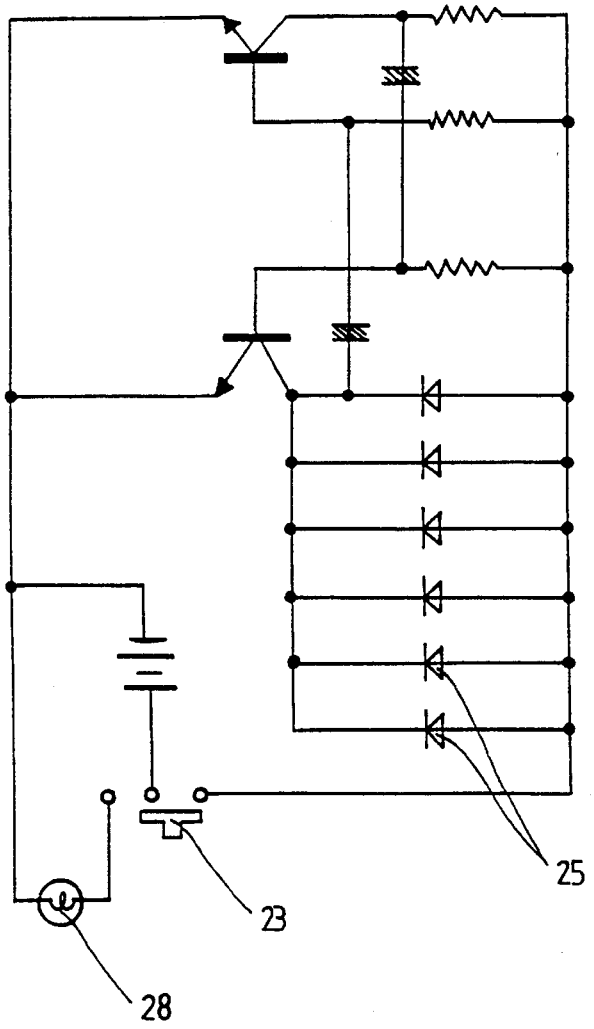
FIG. 3 is a circuit diagram of the light of this invention.
Figure 2:
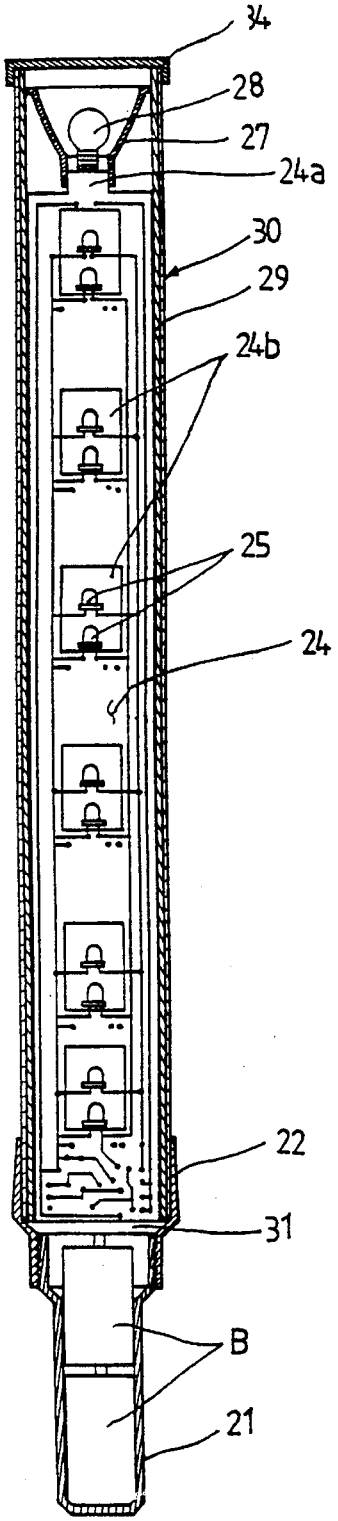
FIG. 2 is a sectional view of the assembled light of FIG. 1.
Figure 4:
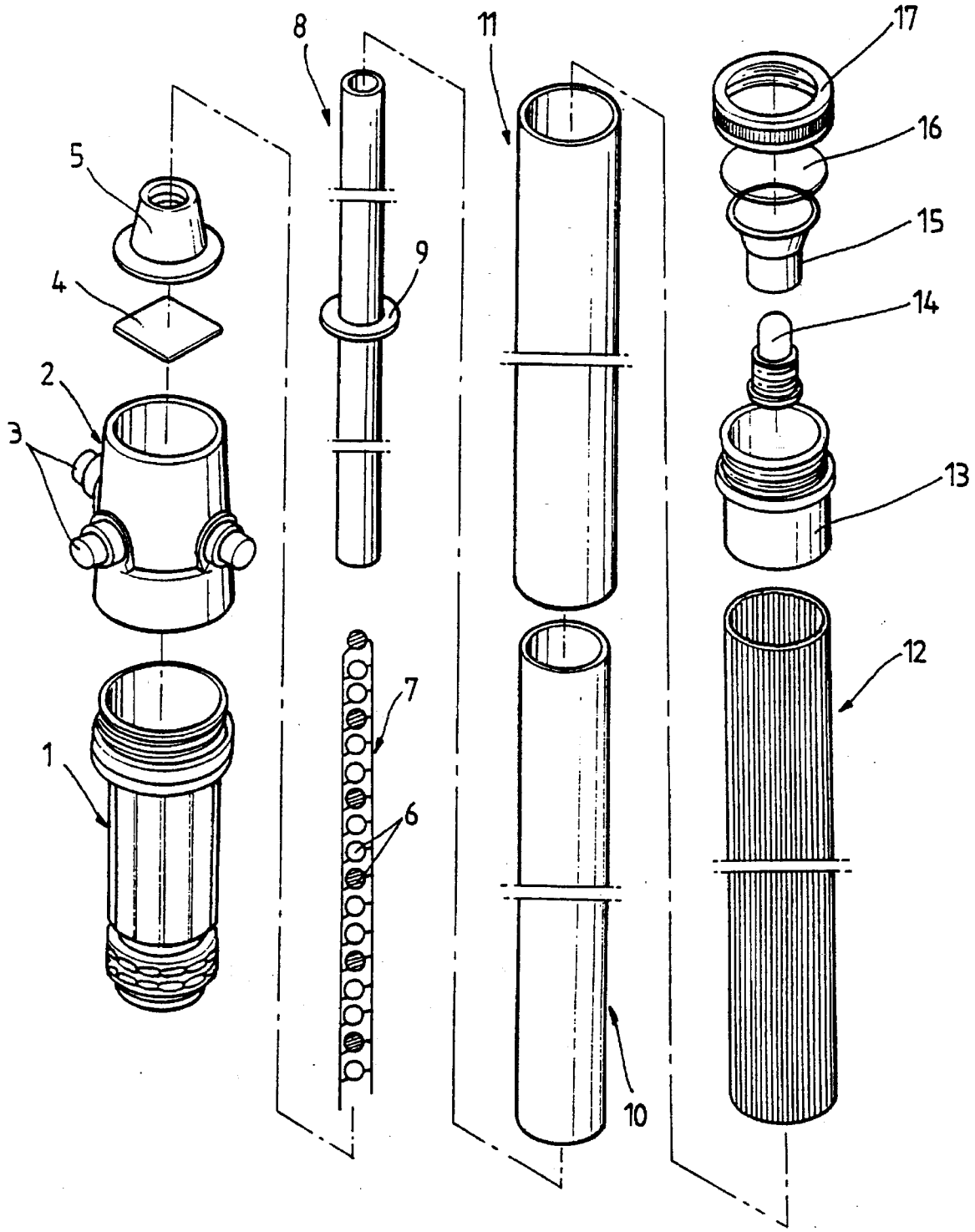
FIG. 4 is an exploded perspective view of a typical hand-carried traffic control light.

FIG. 1 is an exploded perspective view of a hand-carried traffic control light in accordance with a preferred embodiment of the present invention. FIG. 2 is a sectional view of the assembled light of FIG. 1. FIG. 3 is a circuit diagram of the above light.

As shown in the drawings, the traffic control light 20 of this invention includes a cylindrical handle 21 that defines a battery chamber for receiving batteries B. A switch cap 22 is threaded into the top of the above handle 21. The switch cap 22 has a multistage switch 23. A longitudinal LED carrier 24, that carries a plurality of LEDs 25 and a circuit unit 26, is axially fitted in the handle 21 thereby being held by the handle 21. A reflector 27 with a flashing bulb 28 is held on a holding protrusion **24*a* provided on the top of the LED carrier 24. The LED carrier 24 with the reflector 27 is surrounded by a color reflecting tube 29. The above color reflecting tube 29 is turn is surrounded by an external tube 30**.

The above switch cap 22 is also provided with both a terminal plate 31 and a switch connector 32. The terminal plate 31 is electrically connected to the batteries B of the handle 21. The switch connector 32 is connected to an LED connector 33 provided on the circuit unit 26 of the LED carrier 24.

The above LED carrier 24 has a width that is almost equal to the inner diameter of the external tube 30. The LED carrier 24 is formed of a PCB (printed circuit board). The carrier 24 also includes a plurality of regularly-spaced openings **24*b*. The circuit unit 26 is arrayed about the openings 24*b***.

The LEDs 25 are electrically connected to the circuit unit 26 about the openings **24*b*. The above LEDs 25** include two sets of color LEDs that are electrically connected to different circuits.

The reflector 27 is held by the holding protrusion 24*a* formed on the top of the LED carrier 24. The flashing bulb 28 that is fitted in the above reflector 27 is electrically connected to another circuit arrayed on the LED carrier 24.

The above color reflecting tube 29 is a cylindrical tube formed of a fluorescent and reflecting material. Of course, the tube 29 transmits the light of the LEDs 25.

The external tube 30 surrounds the color reflecting tube 29. The above tube 30, that is mounted to the switch cap 22 on its bottom end, is a transparent cylindrical tube formed of a synthetic resin. The tube 30 is provided with a plurality of reflecting micro protrusions on its internal surface. Fitted over the top of the external tube 30 is a transparent cap 34 that protects both the reflector 27 and the bulb 28. The light of the bulb 28 is put forward through the transparent cap 34 while being reflected by the reflector 27.

The operational effect of the above light will be described hereinbelow.

In order to assemble the above light, the connector 32 of the switch cap 22 is connected to the connector 33 of the LED carrier 24. The color reflecting tube 29 is fitted over the LED carrier 24 prior to fitting the external tube 30 over the above reflecting tube 29.

Since the width of the LED carrier 24 is almost equal to the inner diameter of the external tube 30 as described above, the LED carrier 24 in the above state is brought into tight contact with the tubes 29 and 30. The above LED carrier 24 is thus tightly held by the tubes 29 and 30. Since both sides of the LED carrier 24 come into tight contact with the tubes 29 and 30, the tubes 29 and 30 are structurally reinforced by the LED carrier 24, thereby being prevented from external shock.

Thereafter, the external tube 30 with the LED carrier 24 is assembled with the switch cap 22 by fitting the bottom end of the tube 30 into the switch cap 22.

In the operation of the above light, the switch 23 of the switch cap 22 is operated to apply the electric power of the batteries B in the handle 21 to the LED carrier 24. The LEDs 25 of the carrier 24 are thus intermittently turned on and off.

The light of the above LEDs 25 comes through the color reflecting tube 29 and the external tube 30. The light of the LEDs 25 in the above state is diffused to have the luminous effect while it comes through the color reflecting tube 29.

Since the external tube 30 is provided with the reflecting micro protrusions on its internal surface, the luminous effect of the LED's light is more improved.

The above hand-carried light thus provides a sufficient visibility range and improves the visual effect at night, interruption of electric power or inclement weather. Therefore, the above light is effectively used for signaling or traffic controlling in such conditions.

In order to use the above light for identifying the registered number of a car or the mentioned items of a driver's license or searching the troubled parts of a car, the multistage switch 23 is operated to apply the electric power of the batteries B to the flashing bulb 28. The bulb 28 comes into a series connection with the batteries B thereby being continuously turned on. The bulb 28 in the above state thus puts its light forward through the transparent cap 34 while being reflected by the reflector 27. The above hand-carried light is thus used for properly identifying the registered number of a car or the mentioned items of a driver's license or search the troubled parts of a car.

As described above, the present invention provides a hand-carried traffic control light having both the signaling function and the flashing function. In the above hand-carried light, the signaling and flashing units are commonly provided in the LED carrier formed of a PCB, thereby simplifying the construction of the light. The hand-carried light of this invention reduces the number of parts, weight and volume, thus being easily produced and assembled.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hand-carried traffic control light comprising:

a cylindrical handle receiving batteries;

a switch cap threaded into said handle, said switch cap having a multistage switch on its outer wall;

a longitudinal LED carrier formed of a printed circuit board and electrically coupled to a connector of said switch cap thereby being connected to said switch, said LED carrier having a plurality of openings;

a circuit unit provided in said LED carrier and connected to both the batteries and the switch;

a plurality of LEDs mounted to said openings of the LED carrier respectively to be electrically connected to said circuit unit thereby being selectively applied with electric power of the batteries in accordance with a switching motion of said switch;

a holding protrusion provided on a top of said LED carrier;

a reflector and a flashing bulb held on said holding protrusion and connected to said circuit unit, said bulb being selectively applied with electric power of the batteries in accordance with the switching motion of the switch;

a color reflecting tube surrounding said LED carrier;

an external tube surrounding said color reflecting tube; and a transparent cap fitted over a top of said external tube to protect both the reflector and the bulb.

* * * * *